US007573211B2

(12) United States Patent
Liu

(10) Patent No.: US 7,573,211 B2
(45) Date of Patent: Aug. 11, 2009

(54) BACKLIGHT CONTROL CIRCUIT

(75) Inventor: Jing-Meng Liu, Jubei (TW)

(73) Assignee: Richtek Technology Corporation, Hsin-Chu (TW)

( * ) Notice: Subject to any disclaimer, the term of this patent is extended or adjusted under 35 U.S.C. 154(b) by 29 days.

(21) Appl. No.: 11/809,850

(22) Filed: Jun. 4, 2007

(65) Prior Publication Data

US 2008/0111504 A1 May 15, 2008

(30) Foreign Application Priority Data

Nov. 13, 2006 (TW) ..... 95141918 A

(51) Int. Cl.
*G05F 1/00* (2006.01)

(52) U.S. Cl. ..... 315/307; 315/291

(58) Field of Classification Search ..... 315/291, 315/307, 224; 363/59, 56.1, 56.11; 327/107, 327/111

See application file for complete search history.

(56) References Cited

U.S. PATENT DOCUMENTS

| | | | | |
|---|---|---|---|---|
| 6,657,876 | B2 * | 12/2003 | Satoh | 363/60 |
| 7,113,077 | B2 * | 9/2006 | Masters et al. | 340/425.5 |
| 7,262,582 | B2 * | 8/2007 | Warita et al. | 323/222 |
| 7,304,871 | B2 * | 12/2007 | Ito et al. | 363/59 |
| 7,368,977 | B2 * | 5/2008 | Wei et al. | 327/536 |
| 2002/0047642 | A1 * | 4/2002 | Miyagawa | 315/307 |

* cited by examiner

*Primary Examiner*—Douglas W Owens
*Assistant Examiner*—Minh D A
(74) *Attorney, Agent, or Firm*—Tung & Associates

(57) ABSTRACT

The present invention discloses a backlight control circuit, comprising: a voltage supply circuit, which is a boost converter circuit for receiving an input voltage from an input terminal and generating an output voltage to an output terminal, the output voltage being provided as an operating voltage for a plurality of light emitting devices; at least one input capacitor electrically connected between the input terminal and ground; and at least one output capacitor electrically connected between the output terminal and the input terminal.

17 Claims, 10 Drawing Sheets

BACKLIGHT CONTROL CIRCUIT

FIELD OF INVENTION

The present invention relates to a backlight control circuit. More particularly, the present invention relates to a backlight control circuit which uses a low voltage rating capacitor to provide a high output voltage.

BACKGROUND OF THE INVENTION

In a liquid crystal display, a backlight control circuit is used which controls light emitting diodes (LEDs) to illuminate from the back side of a liquid crystal screen, so that a user can observe an image from the front side of the liquid crystal screen.

In early days, LED backlight is used only in a small size screen, which does not require high backlight brightness. Therefore, the LEDs can be connected all in series or all in parallel. FIG. 1 shows a prior art circuit wherein all LEDs are connected in series. As shown in the figure, a backlight control circuit 1 comprises a backlight control integrated circuit 10 which includes an input terminal and an output terminal, wherein the input terminal is connected with an input capacitor Cin to receive an input voltage Vin, and the output terminal is connected with an output capacitor Cout to provide an output voltage Vout. (Besides the backlight control integrated circuit 10 and the two above-mentioned capacitors, other devices irrelevant to the spirit of the present invention, such as magnetic devices, are omitted for simplicity.)

The backlight control integrated circuit 10 provides output voltage Vout to a plurality of LEDs L1-LN connected in series, and the output voltage Vout is provided via a voltage supply circuit 11 according to a signal 15 which is outputted from an error amplifier circuit 13. A resistor R is provided on a path of the LEDs connected in series, and a voltage at a node Vsense1 is compared with a reference voltage Vref to check whether a current through the path satisfies a predetermined condition. If the current is lower than a predetermined value and the voltage at the node Vsense1 decreases, the error amplifier circuit 13 sends the signal 15 to the voltage supply circuit 11 to pull up the output voltage Vout, so that the current flowing through the LEDs increases. Additionally, to avoid the voltage supply circuit 11 from unlimitedly increasing the output voltage Vout (for example, when the error amplifier circuit 13 malfunctions, or when the path of the LEDs is open), an over voltage protection circuit 12 is provided in the backlight control integrated circuit 10, which detects the output voltage Vout and sends a signal to stop the voltage supply circuit 11 from increasing Vout if the output voltage Vout is excessively high. (Depending on circuit design, the voltage supply can be totally stopped, or kept at an upper limit value. The latter is more popular in a backlight control circuit.)

FIG. 2 shows a typical structure of an over voltage protection circuit 12, wherein the output voltage Vout is monitored by comparing the voltage at the node Vsense2 with a reference voltage Vovp. The result of comparison determines a signal for controlling the voltage supply circuit 11.

Referring to FIG. 3, it shows a conventional backlight control circuit with LEDs all connected in parallel. As shown in the figure, a backlight control circuit 2 comprises a backlight control integrated circuit 20, wherein the currents passing through LEDs L1-LN are respectively controlled by the current sources CS1-CSN. The backlight control integrated circuit 20 comprises a minimum voltage selection circuit 21 which chooses a lowest voltage value among all voltages at cathode ends of the LEDs L1-LN, and the error amplifier circuit 13 compares the lowest voltage value with a reference voltage to generate a signal controlling the voltage supply circuit 11. Thus, the output voltage Vout is under control so that all current source circuits are provided with sufficient operating voltage for normal operation, and all LEDs can illuminate normally thereby.

Similarly, the backlight control integrated circuit 20 can further comprise an over voltage protection circuit 12 as the one described above.

The number of LEDs that are allowed to be connected all in series or all in parallel in the above conventional arrangements is limited, and naturally this leads to connecting the LEDs partially in series and partially in parallel (series-parallel connection). FIG. 4 shows a prior art arrangement of such series-parallel connection in which the backlight control integrated circuit 10 shown in FIG. 1 is employed to provide voltage to a series-parallel connection circuit of LEDs. However, it only checks the current on the path of LEDs L1-LN but does not check those on the other paths.

Another prior art arrangement is shown in FIG. 5 which employs the backlight control integrated circuit 20 shown in FIG. 3 to compose a series-parallel connection circuit for LEDs.

In the above circuits shown in FIGS. 1, 4, and 5, the larger the number of the series-connected LEDs is, the higher the required output voltage Vout is. Correspondingly, a higher voltage rating capacitor is required for the output capacitor, which will increase the total cost of the backlight control circuit.

SUMMARY OF THE INVENTION

In view of the foregoing, it is therefore an objective of the present invention to provide a backlight control circuit capable of supplying a relatively high output voltage by means of a relatively low voltage rating capacitor, to solve the above-mentioned cost and other issues.

In accordance with the foregoing and other objectives of the present invention, and as disclosed by an embodiment of the present invention, a backlight control circuit is provided, which comprises a voltage supply circuit, which receives an input voltage from an input terminal and generates an output voltage to an output terminal, wherein the output voltage being provided as an operating voltage for a plurality of light emitting devices; at least one input capacitor electrically connected between the input terminal and ground; and at least one output capacitor electrically connected between the output terminal and the input terminal.

Preferably, the voltage supply circuit further comprises a noise filtering circuit to avoid a noise problem from the electrical connection between the output capacitor and the input terminal.

Moreover, a power supply with a low internal impedance is preferred for providing the input voltage; in other words, a power supply having a low impedance for both current sourcing and current sinking is preferred.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT

The voltage of a white or blue LED may vary in a range from 3.3V to 4V due to manufacture deviation. To cope with it, in circuit design, the necessary output voltage Vout is calculated by 4V multiplied by the number of LEDs connected in series in a path. That is, if the number of LEDs in a path is more than or equal to 13, the Vout is higher than 50V. (4*13=52>50)

Figure 1:
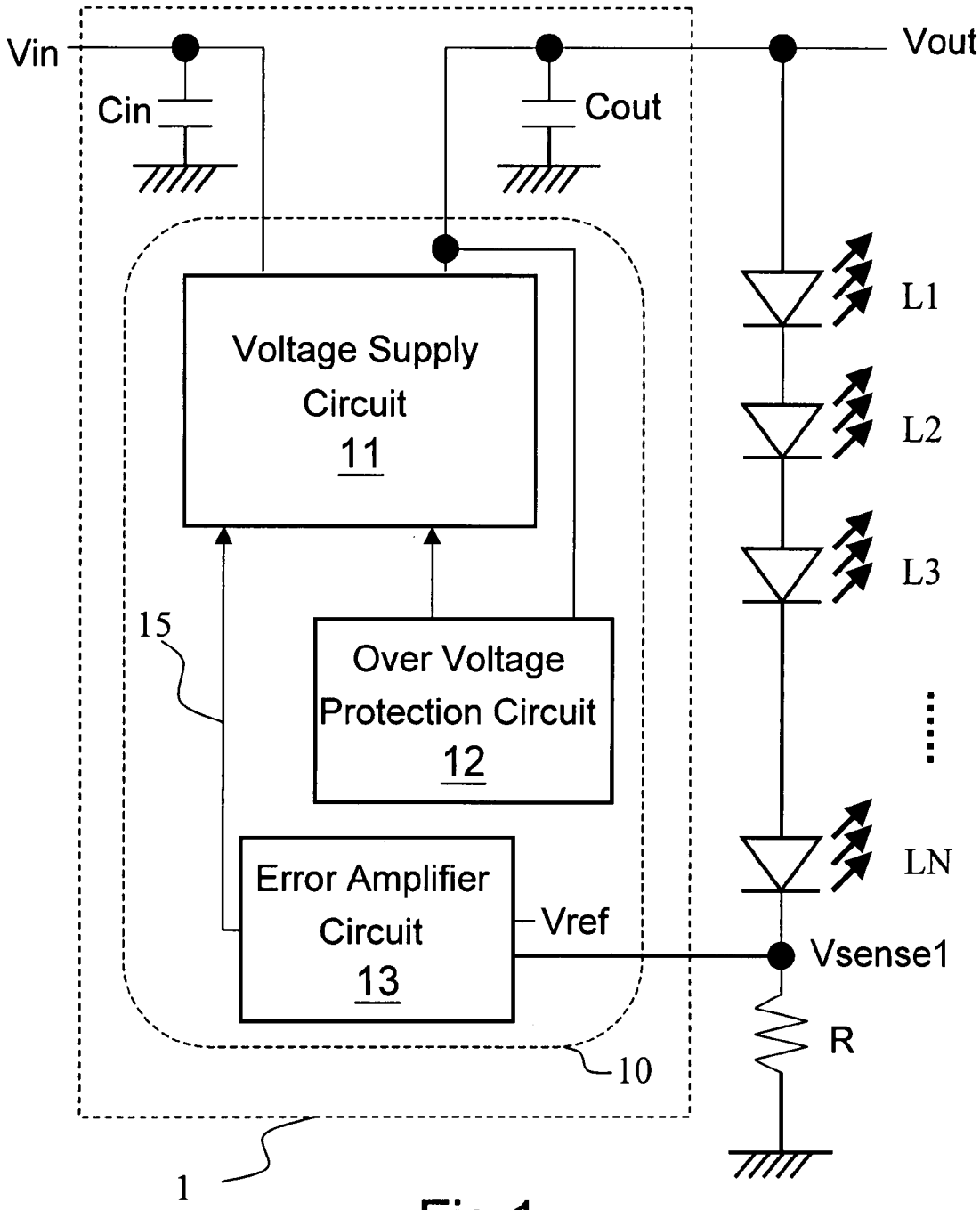
Fig.1 (Prior Art)
FIG. 1 is a schematic circuit diagram showing a prior art circuit including LEDs which are all connected in series and a backlight control circuit thereof.
Figure 4:
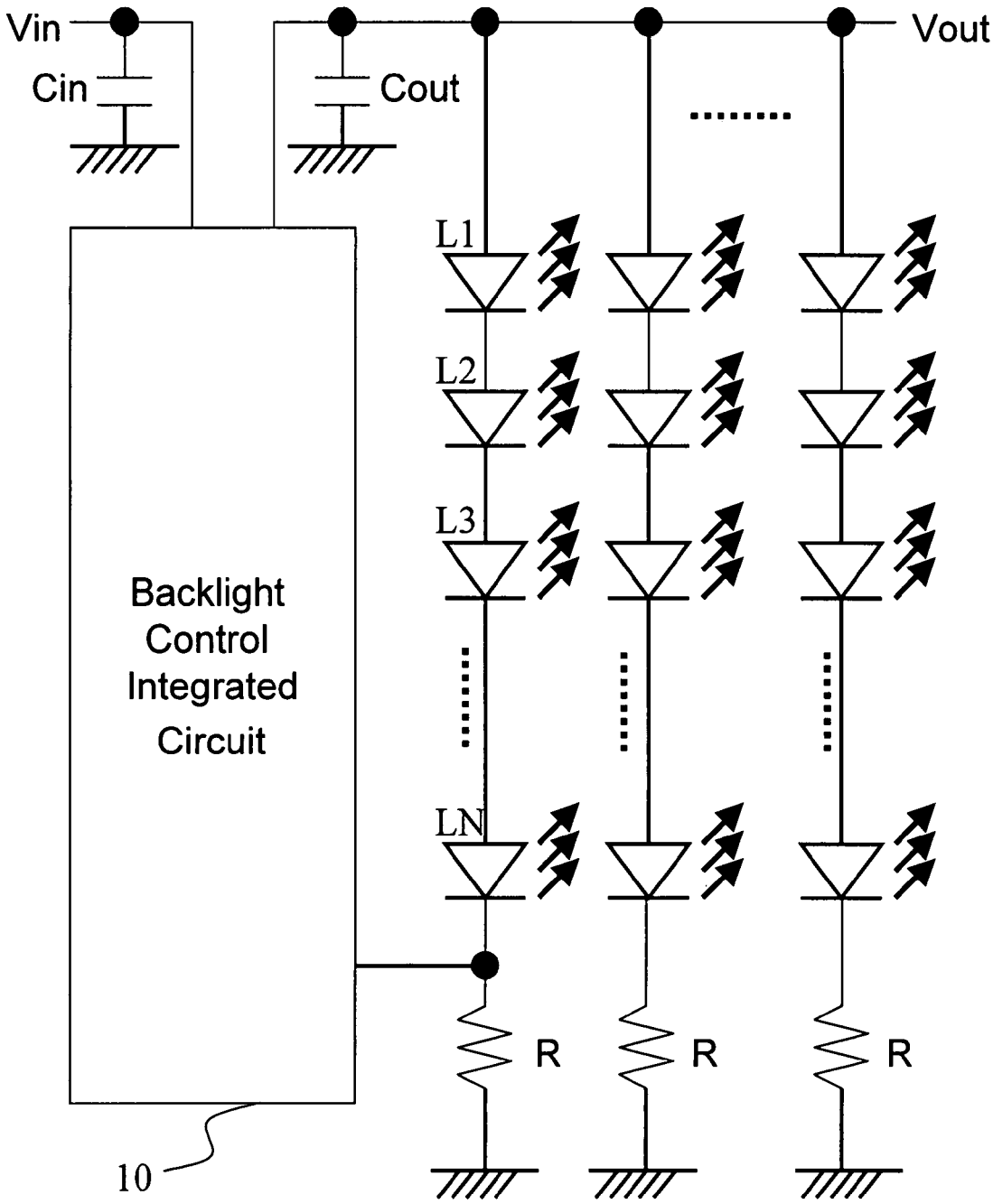
Fig.4 (Prior Art)
FIG. 4 is a schematic circuit diagram showing a prior art circuit including LEDs which are connected partially in series and partially in parallel, and a backlight control circuit thereof.
Figure 5:
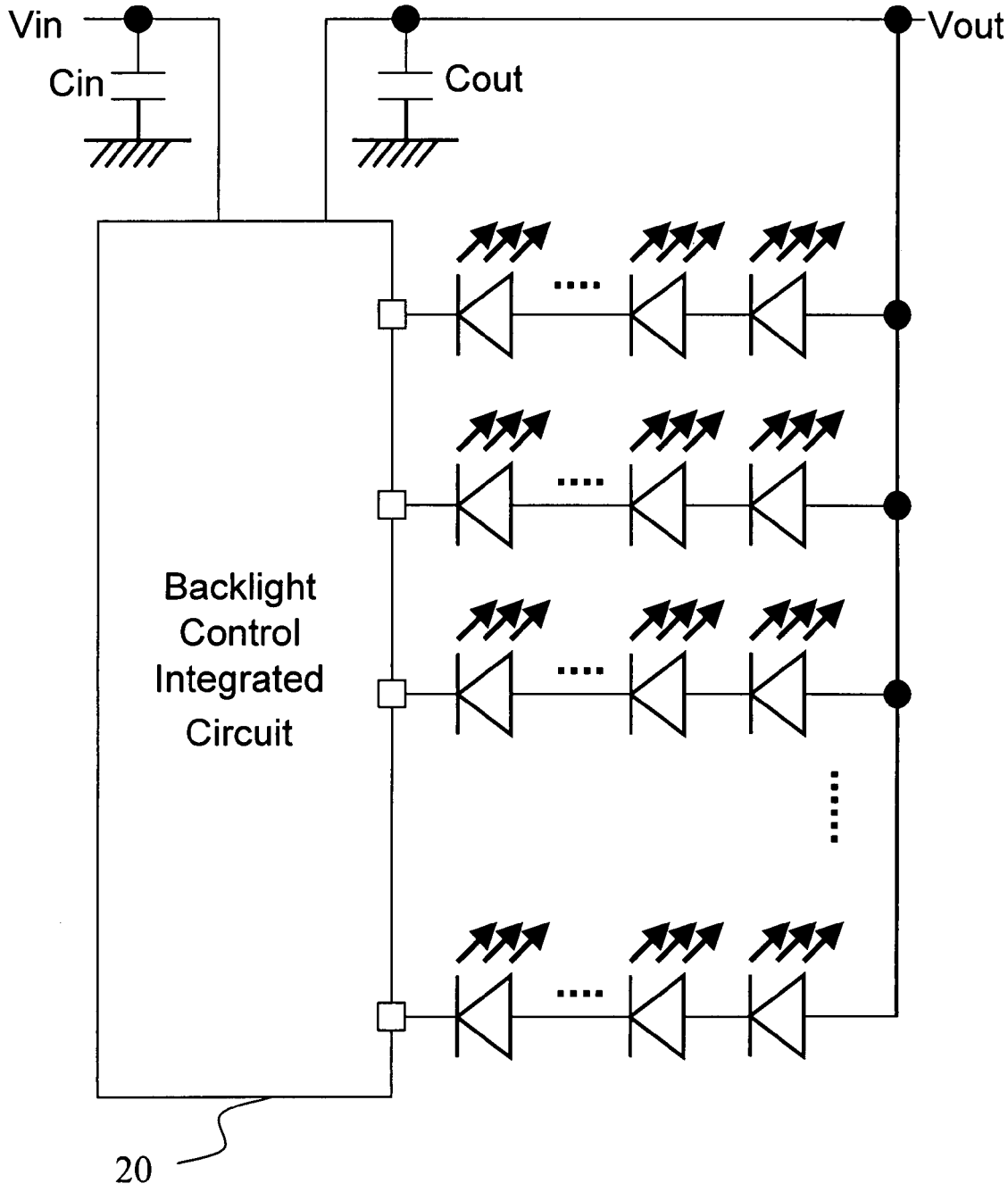
Fig.5 (Prior Art)
FIG. 5 is a schematic circuit diagram showing another prior art circuit including LEDs which are connected partially in series and partially in parallel, and a backlight control circuit thereof.

Considering the demand for thin thickness, small size, low parasitic resistance, environmental protection, and cost effectiveness, ceramic capacitor is currently the best choice for an LED backlight circuit. The nominal voltage ratings of ceramic capacitors are classified as: 6.3V/10V/16V/25V/50V/100V/200V/ . . . , and the corresponding cost greatly increases as the rating goes higher (i.e., using a higher voltage rating capacitor). For example, the cost of a 100V rating capacitor is twice more than that of a 50V rating capacitor. In the prior art circuits shown in FIGS. 1, 4, and 5, if the number of LEDs in the series-connection path is more than or equal to 13, a 100V rating capacitor must be used as the output capacitor Cout.

Figure 6:
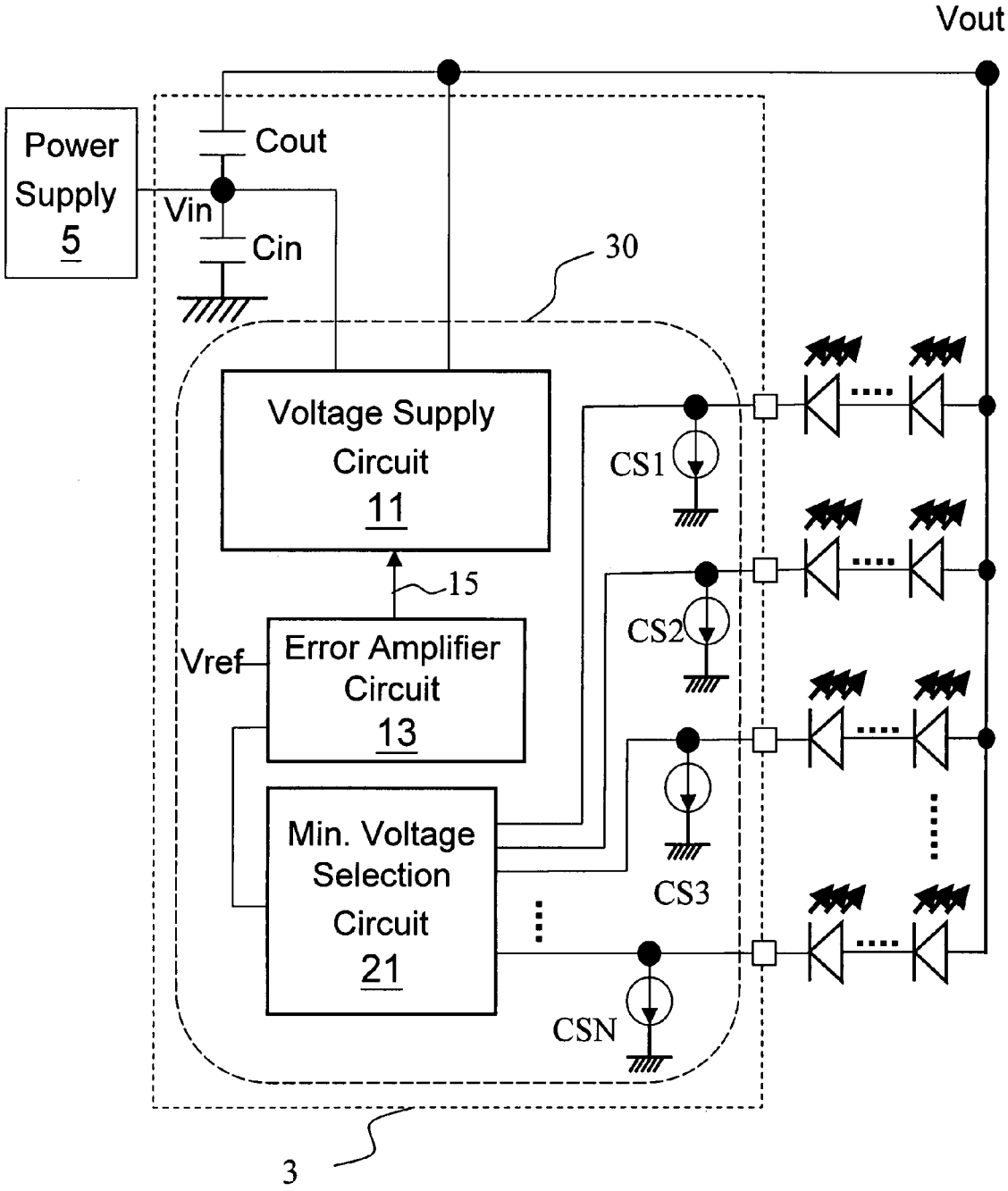
FIG. 6 is a schematic circuit diagram showing a backlight control circuit according to an embodiment of the present invention.

The present invention is more cost-saving because it can use a relatively low voltage rating capacitor as the output capacitor Cout. FIG. 6 shows a circuit diagram according to an embodiment of the present invention, wherein a backlight control circuit 3 comprises a backlight control integrated circuit 30 and two external capacitors Cin and Cout electrically connected therewith. The input voltage Vin is provided by a power supply 5. One feature of the present invention is that the output capacitor Cout is electrically connected to the input terminal instead of ground. Therefore, the span voltage of the output capacitor Cout becomes Vout-Vin, and a capacitor with voltage rating lower than Vout can be used.

The input voltage Vin to a white LED backlight control circuit in currently popular applications, such as notebook computers or other products, is probably provided by 3 or 4 Li-ion batteries or Li-polymer batteries connected in series, which is under about 24V (charger voltage included) and typically between about 10V to about 24V; however, when the battery energy is close to running out, it can be under 10V. The maximum output voltage Vout is about 40V to about 60V, for 10-15 white LEDs connected in series. In some other applications, the input voltage Vin is provided by two Li-ion batteries or Li-polymer batteries, which is under about 15V (charger voltage included) and typically between about 6.6V to about 15V; however, when the battery energy is close to running out, it can be under 6.6V. The maximum output voltage Vout is about 24V to about 32V for 6-8 white LEDs connected in series. (In other words, the voltage supply circuit 11 is usually a boost converter circuit.) Referring to the prior art circuits shown in FIGS. 1, 4, and 5, these circuits must use a 100V rating capacitor as its output capacitor when the output voltage Vout is higher than 50V. However in contrast, according to the embodiment of the present invention under the same condition, the input capacitor Cin can be a 25V rating capacitor and the output capacitor Cout can be a 50V rating capacitor. (Or, the output capacitor Cout can even be a 25V rating capacitor or a capacitor of other lower ratings, depending on the difference between the output voltage Vout and the input voltage Vin.) Thus, it is not required to use a capacitor having a rating equal to or higher than the output voltage Vout.

Because the output terminal is connected to the input terminal via the output capacitor Cout, a noise in the output terminal (for example, a ripple noise) may be transmitted into the backlight control circuit 3 through the input terminal. The present invention discloses a solution thereto, as described below.

Figure 7:
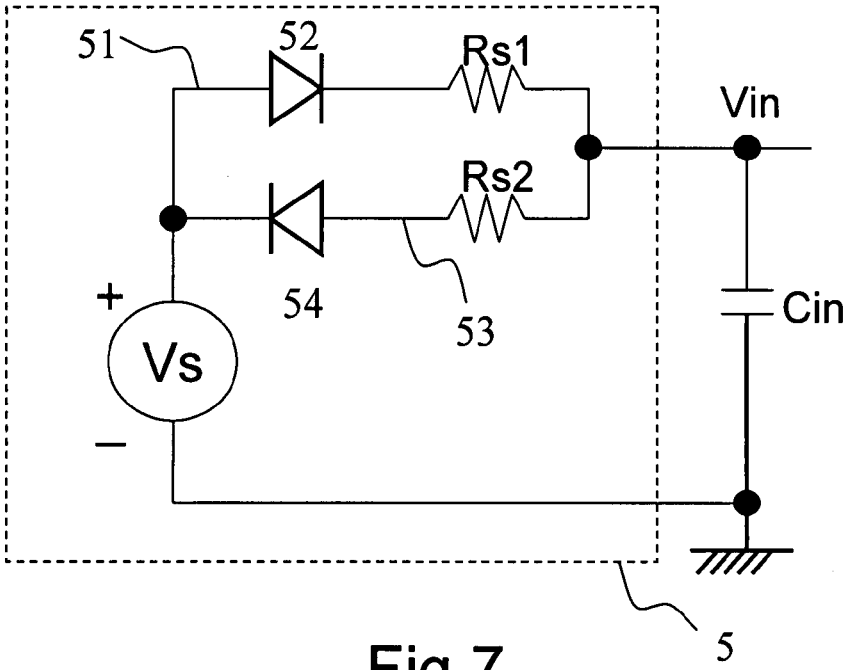
FIG. 7 is a diagram for explaining the internal working model of a power supply.

Preferably, the power supply providing the input voltage Vin is a power supply having a low internal impedance. FIG. 7 shows a working model of the power supply for providing the input voltage Vin, wherein the power supply 5 comprises an ideal voltage supply source Vs and two paths: a current sourcing path 51 composed of an ideal diode 52 (having a conductive span voltage of zero) and a resistor Rs1, and a current sinking path 53 composed of an ideal diode 54 and a resistor Rs2. (Rs1, Rs2 are referred to as "internal impedances".)

According to the inventor's analysis, when a noise at the output terminal is coupled to the input terminal via the output capacitor Cout, the noise coupling effect correlates to the Cout/Cin ratio, and the resistances of Rs1 and Rs2. The larger the Cout/Cin ratio, or the resistances of Rs1 and Rs2 are, the more obvious the noise coupling effect is.

Consequently, according to the present invention, the power supply 5 which provides input voltage Vin is preferably a power supply with low internal impedance, i.e., low Rs1 and Rs2 resistances. Preferred power supplies include: Li-ion batteries, Li-polymer batteries, NiCd batteries, NiMH batteries, fuel cells, and a power supply connected in parallel with a super capacitor (having a capacitance higher than 0.1 F), etc.

Further, to avoid the noise influence on the voltage supply circuit 11, the backlight control circuit 30 preferably comprises a circuit with noise filtering function, such as a regulator circuit, a filter circuit such as a low-pass filter circuit, or a spike voltage damper circuit. The input voltage Vin is transmitted into the voltage supply circuit 11 only after it has been subject to noise filtering. Such noise filtering circuit can be disposed inside or outside the integrated circuit 30.

Figure 8:
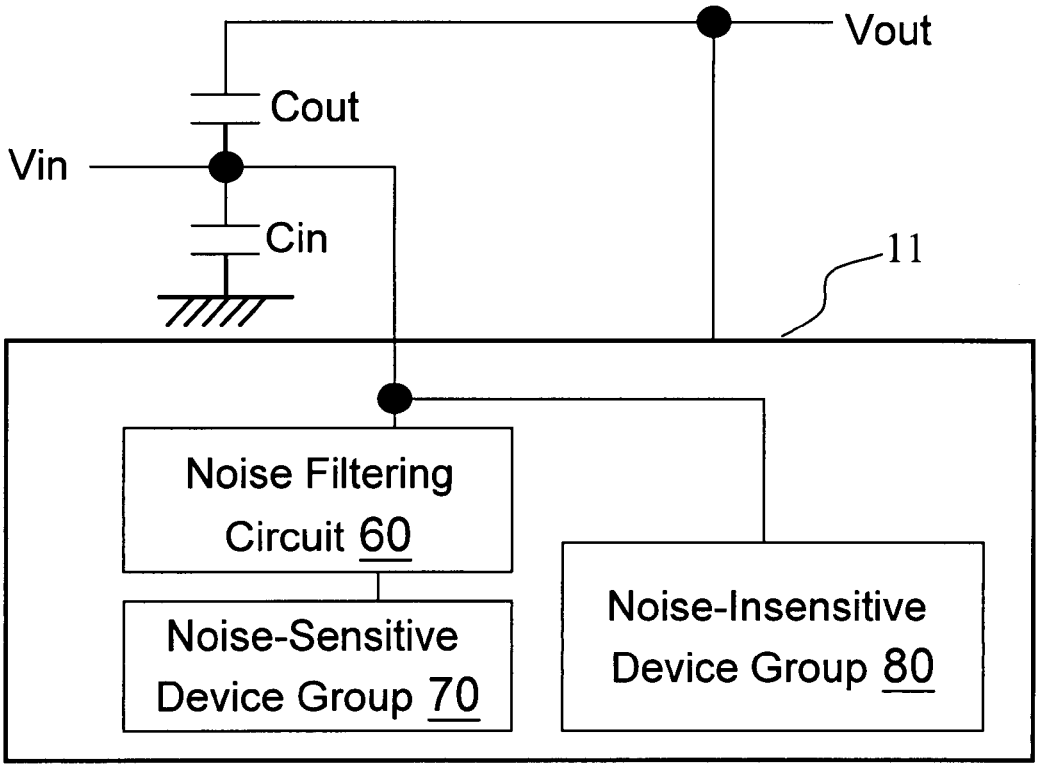
FIGS. 8 and 9 are schematic circuit diagrams showing the arrangement of a noise filtering circuit in the voltage supply circuit 11.
Figure 9:
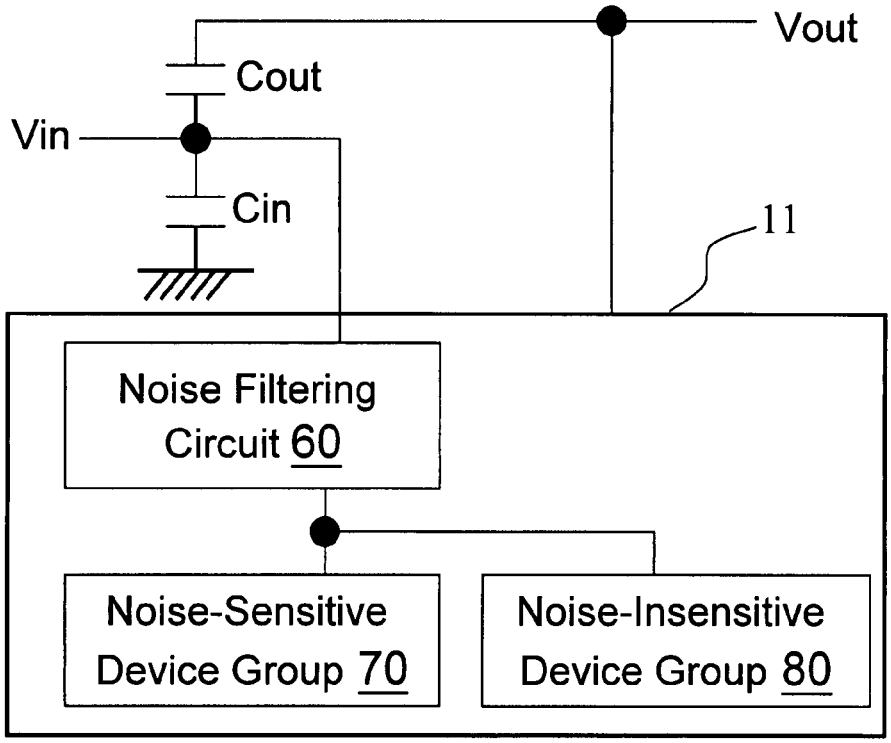
Figure 10A:
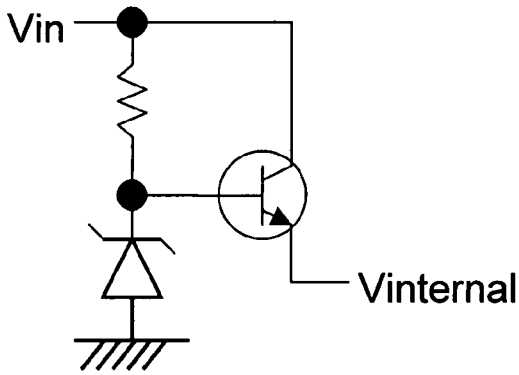
FIGS. 10A-10D are diagrams showing four embodiments of regulator circuits.
Figure 10B:
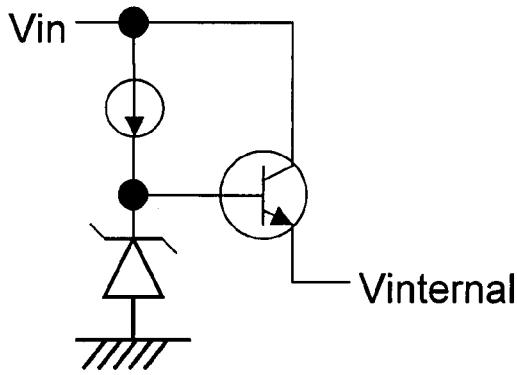
Figure 10C:
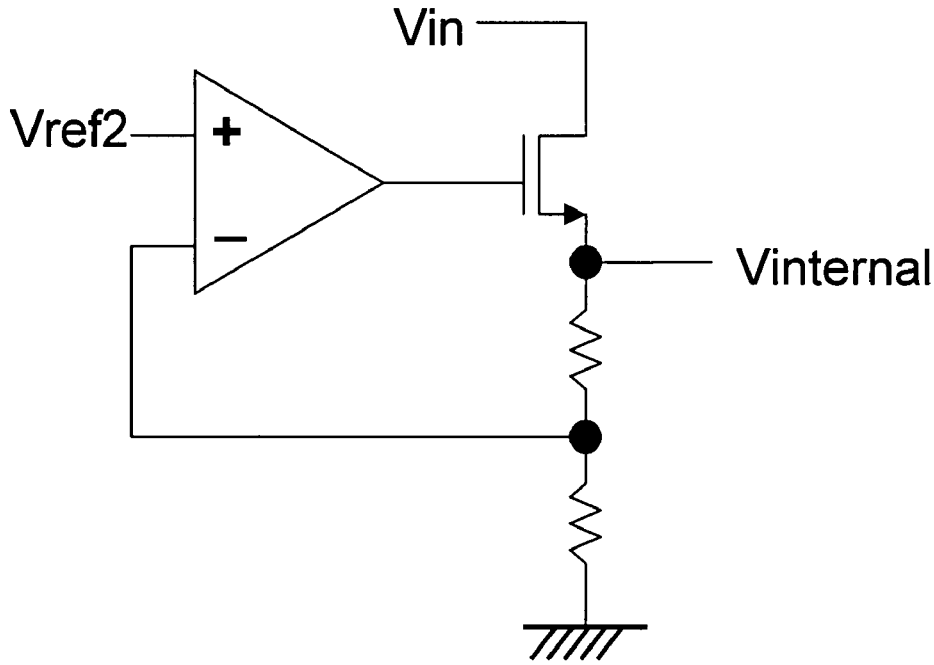
Figure 10D:
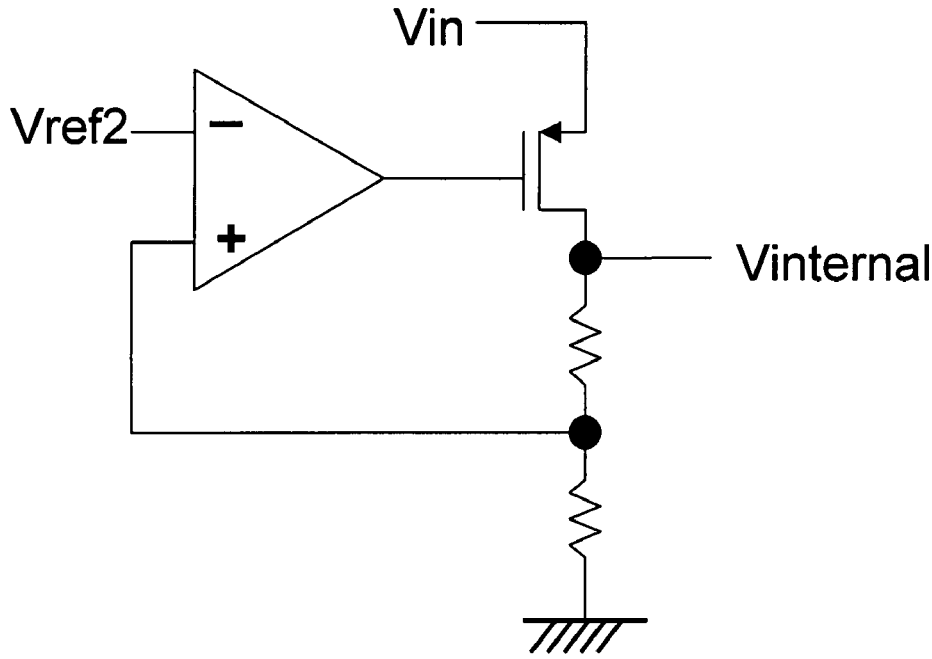

FIG. 8 better illustrates the noise filtering concept described above, wherein the voltage supply circuit 11 comprises a group of devices which are sensitive to noises (noise sensitive device group 70) and a group of devices which are insensitive to noises (noise insensitive device group 80). The noise sensitive device group 70 includes, e.g., a reference voltage supplier circuit, a current bias circuit, an error amplifier circuit, a comparator circuit, an oscillator circuit, a voltage sensor circuit, a current sensor circuit, and a temperature sensor circuit, etc. The noise insensitive device group 80 includes, e.g., a level shifter circuit, a power stage circuit, etc. (The details of a voltage supply circuit is well known to the people skilled in the art, so the detailed circuit structure is omitted for simplicity.) The input voltage Vin at the input terminal passes through a noise filtering circuit 60 to be subject to noise filtering, and afterwards supplied to the noise sensitive devices of the group 70, while the noise insensitive devices of the group 80 directly receive the unfiltered input voltage Vin. As an alternative, referring to FIG. 9, the noise insensitive devices of the group 80 can also receive the filtered input voltage Vin. The noise filtering circuit 60 is disposed inside the voltage supply circuit 11 in FIGS. 8 and 9, yet the noise filtering circuit 60 certainly can be disposed outside the voltage supply circuit 11 or even outside the backlight control integrated circuit 30.

As described in the above, the noise filtering circuit 60 can be a regulator circuit, a filter circuit such as a low-pass filter circuit, or a spike voltage clamper circuit. FIGS. 10-12 illustrate several possible embodiments of such circuits.

FIGS. 10A-10D show four embodiments of the regulator circuits according to the present invention, each of which can regulate the input voltage Vin into a noiseless internal voltage Vinternal for operation of internal devices inside the voltage supply circuit 11.

Figure 11A:
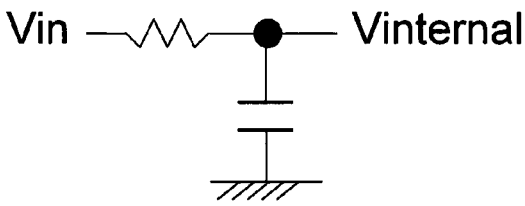
FIGS. 11A and 11B are diagrams showing two embodiments of low-pass filter circuits.
Figure 11B:
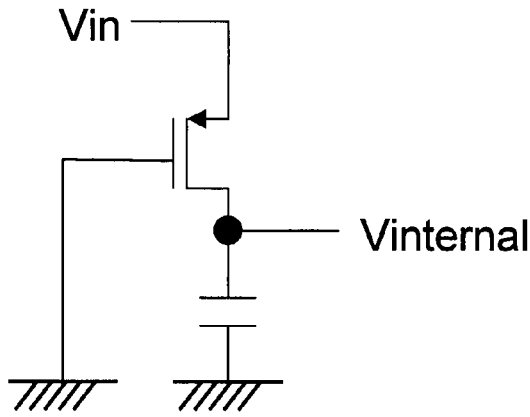

FIGS. 11A and 11B show two embodiments of low-pass filter circuits according to the present invention, each of which can filter high frequency noises in the input voltage Vin and transform it into an internal voltage Vinternal for operation of internal devices inside the voltage supply circuit 11.

Figure 12A:
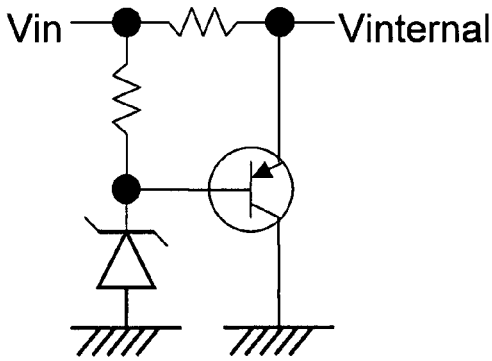
FIGS. 12A and 12B are diagrams showing two embodiments of spike voltage clamper circuits.
Figure 12B:
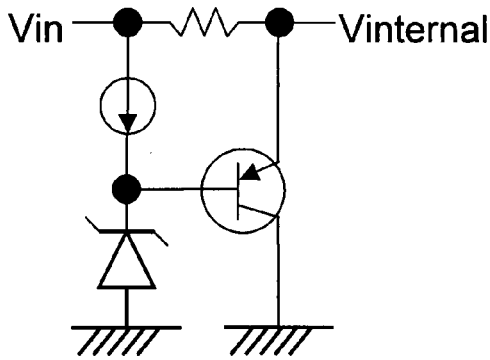

FIGS. 12A and 12B show two embodiments of spike voltage damper circuits according to the present invention, each of which can filter voltage spikes in the input voltage Vin and transform it into an internal voltage Vinternal for operation of internal devices inside the voltage supply circuit 11.

Other embodiments of regulator circuits, low-pass filter circuits, and spike voltage clamper circuits are achievable by the persons skilled in the art under the spirit and within the scope of the present invention, based on respective circuit design requirements.

Figure 2:
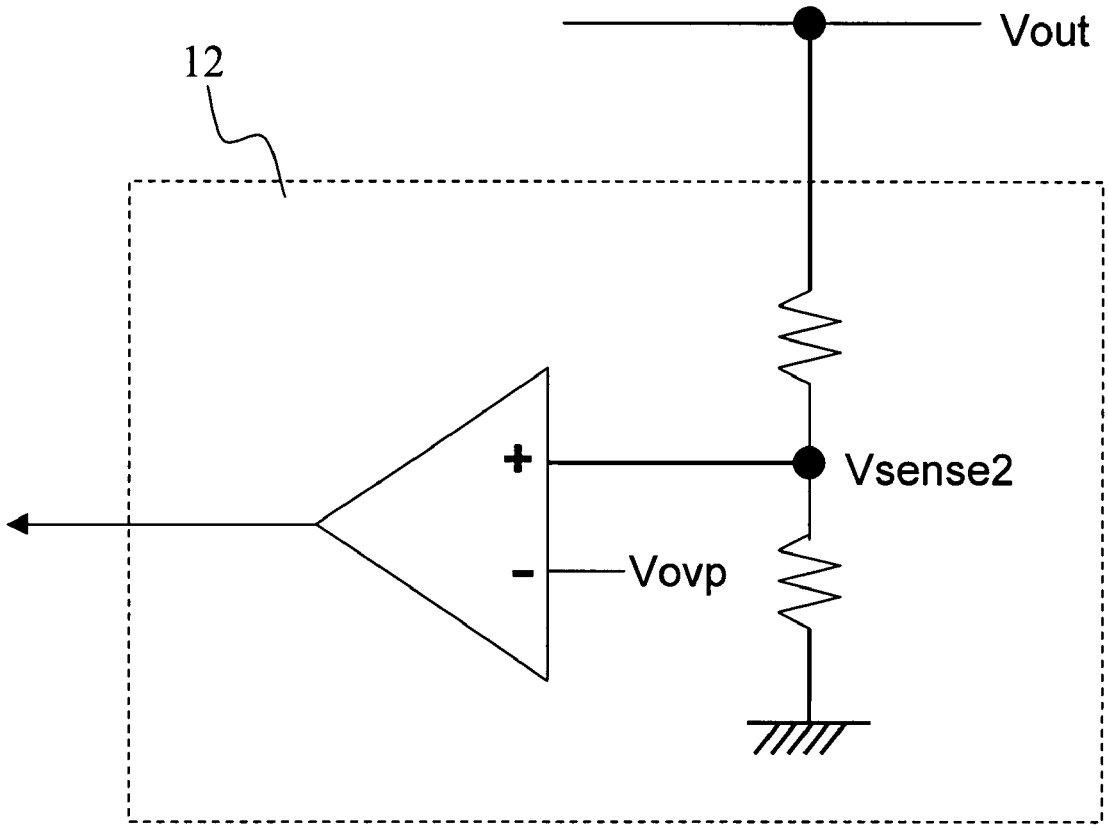
Fig.2 (Prior Art)
FIG. 2 is a schematic circuit diagram showing a conventional over voltage protection circuit.
Figure 3:
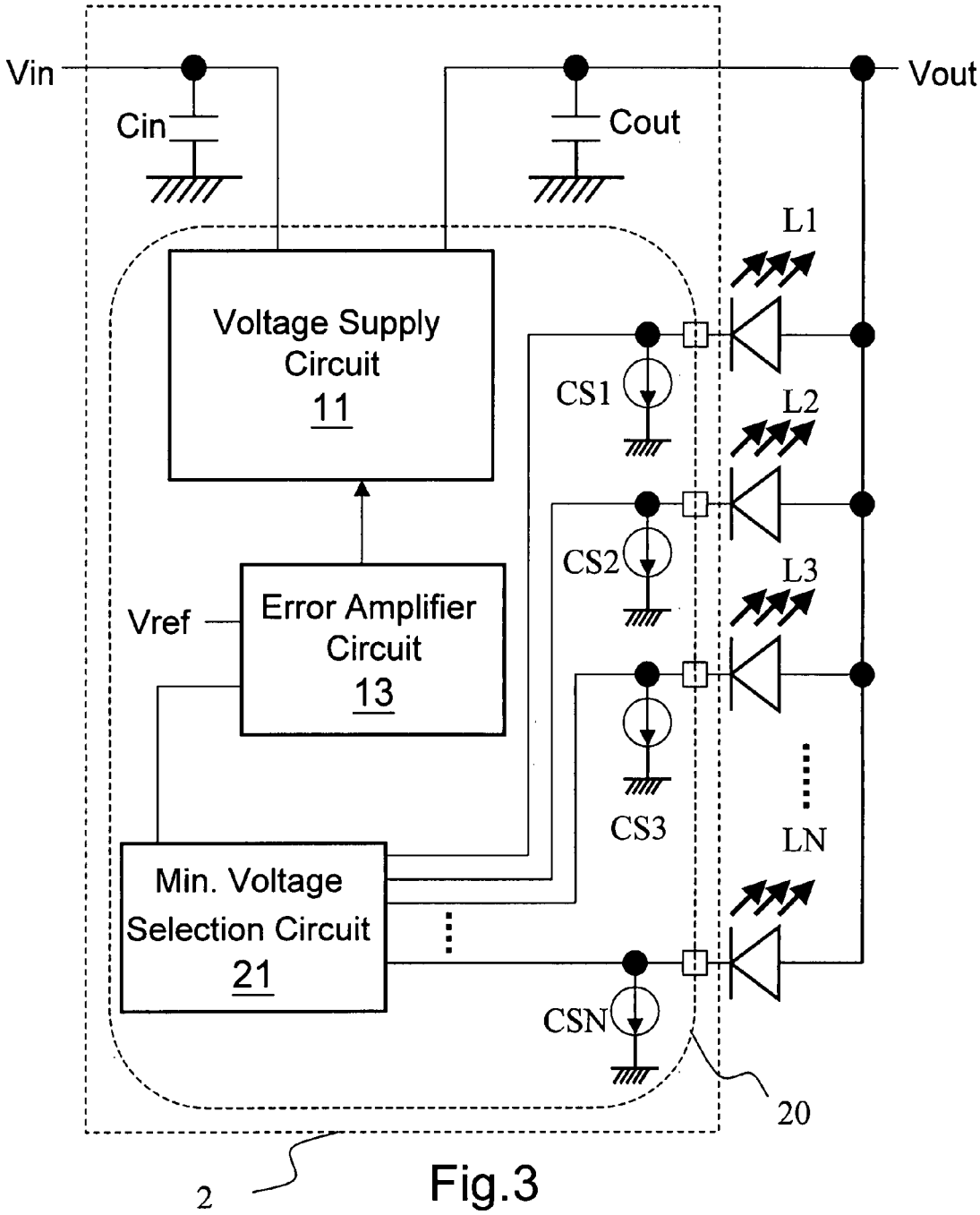
Fig.3 (Prior Art)
FIG. 3 is a schematic circuit diagram showing a prior art circuit including LEDs which are all connected in parallel and a backlight control circuit thereof.

The present invention has been described in considerable detail with reference to certain preferred embodiments thereof, but they are only for illustration of the spirit, rather than for limiting the claim scope of the present invention. For those who are skilled in the art, modifications and variations are readily achievable. For example, although the present invention is more advantageous in the situation where high output voltage is required because of series connection of LEDs, it can similarly apply to the situation where LEDs are all connected in parallel, as shown in FIG. 2. Further, in all of the embodiments, one can insert a circuit which does not affect the primary function, such as a switch circuit, a diode circuit, a resistor circuit and so on, between any two devices which are shown to be directly connected. Furthermore, the embodiments described above show only one capacitor at each of the input terminal and the output terminal, but of course one can provide more than one capacitor at either the input terminal or the output terminal. Moreover, the input capacitor Cin and the output capacitor Cout are shown to be discrete devices in the above, yet Cin and Cout can be integrated in the backlight control integrated circuit 30. In addition, the backlight control integrated circuit 30 of the above embodiments comprises current source circuits, a minimum voltage selection circuit, and an error amplifier circuit to provide a signal 15 to control the voltage supply circuit 11, which is only one example of the possible arrangements of the backlight control integrated circuit 30; there can be other arrangements to control the voltage supply circuit 11 for the backlight control integrated circuit 30. Still further, the light emitting device, although shown as LED in the above, are not limited thereto but can be other light emitting devices such as an organic light emitting diode. And the word "backlight" in the term "backlight control circuit" is not to be taken in a narrow sense that the circuit has to control the backlight of a screen; the present invention can be applied to "active light emission display", or "LED illuminator", or other apparatuses that employ light emitting devices. Therefore, all modifications and variations based on the spirit of the present invention should be interpreted to fall within the scope of the following claims and their equivalents.

What is claimed is:

1. A backlight control circuit, comprising:

a voltage supply circuit which is a boost converter circuit for receiving an input voltage from an input terminal and providing an output voltage to an output terminal, wherein the output voltage is provided for operating a plurality of light emitting devices;

an error amplifier circuit comparing a feedback signal with a reference signal to generate a signal controlling the voltage supply circuit;

at least one input capacitor electrically connected between the input terminal and ground; and at least one output capacitor electrically and statically connected between the output terminal and the input terminal, wherein the input capacitor and the output capacitor are not capacitors of a charge pump, wherein the output capacitor has a voltage rating lower than the output voltage.

2. The backlight control circuit of claim 1, wherein the input voltage is equal to or under about 24V, and the output voltage is within a range of about 40V to about 60V.

3. The backlight control circuit of claim 1, wherein the input voltage is provided by three or four Li-ion batteries or Li-polymer batteries connected in series, and the output voltage is within a range of about 40V to about 60V.

4. The backlight control circuit of claim 1, wherein the input voltage is equal to or under about 15V, and the output voltage is within a range of about 24V to about 32V.

5. The backlight control circuit of claim 1, wherein the input voltage is provided by two Li-ion batteries or Li-polymer batteries connected in series, and the output voltage is within the range of about 24V to about 32V.

6. The backlight control circuit of claim 1, wherein the output voltage is higher than 50V, and the output capacitor has a voltage rating lower than or equal to 50V.

7. The backlight control circuit of claim 1, wherein the output voltage is higher than 25V, and the output capacitor has a voltage rating lower than or equal to 25V.

8. The backlight control circuit of claim 1, wherein the output voltage is provided for operating at least one group of light emitting devices connected in series, and the number of the light emitting devices in the group is higher than or equal to 13.

9. The backlight control circuit of claim 1, wherein the input terminal is electrically connected to a power supply having a low internal impedance.

10. The backlight control circuit of claim 9, wherein the power supply includes one of the followings: a Li-ion battery, a Li-polymer battery, a NiCd battery, a NiMH battery, a fuel cell, and a power supply connected in parallel to a super capacitor.

11. The backlight control circuit of claim 1, wherein the voltage supply circuit comprises a noise filtering circuit, the noise filtering circuit receives an input voltage and provides an internal voltage for operation of internal devices inside the voltage supply circuit.

12. The backlight control circuit of claim 11, wherein the voltage supply circuit comprises a noise sensitive device which receives the internal voltage provided by the noise filtering circuit.

13. The backlight control circuit of claim 12, wherein the noise sensitive device includes at least one of the following devices: a reference voltage circuit, a current bias circuit, an error amplifier circuit, a comparator circuit, an oscillator circuit, a voltage sensor circuit, a current sensor circuit, and a temperature sensor circuit.

14. The backlight control circuit of claim 11, wherein the noise filtering circuit is selected from a group consisting of: a regulator circuit, a filter circuit, and a spike voltage damper circuit.

15. The backlight control circuit of claim 1, wherein the light emitting devices are light emitting diodes.

16. The backlight control circuit of claim 1, wherein the light emitting devices are white light emitting diodes.

17. The backlight control circuit of claim 1, wherein the light emitting devices are organic light emitting diodes.

* * * * *